US005139185A

United States Patent [19]

Medaugh

[11] Patent Number: 5,139,185

[45] Date of Patent: Aug. 18, 1992

[54] MECHANICAL GRIPPING DEVICE

[76] Inventor: Barney Medaugh, 50 Seneca Trail, Denville, N.J. 07834

[21] Appl. No.: 636,218

[22] Filed: Dec. 31, 1990

[51] Int. Cl.[5] ..... A47G 25/90

[52] U.S. Cl. ..... 223/111; 294/19.1; 294/104

[58] Field of Search ..... 223/111, 112, 118, 119; 294/19.1, 104

[56] References Cited

U.S. PATENT DOCUMENTS

| | | | |
|---|---|---|---|
| 916,508 | 3/1909 | Victor | 223/111 |
| 1,374,544 | 4/1921 | Asplund | 223/119 |
| 1,745,292 | 1/1930 | Buser | 294/104 X |
| 2,989,334 | 6/1961 | Browne | 294/19.1 |
| 3,369,834 | 2/1968 | Miles | 294/104 |
| 3,937,512 | 2/1976 | Baughmann | 294/104 X |
| 4,029,229 | 6/1977 | Hobson | 294/104 X |
| 4,709,839 | 12/1987 | Tucker | 223/119 |
| 4,930,825 | 6/1990 | Dearman | 294/104 X |
| 4,966,316 | 10/1990 | George et al. | 223/118 X |

FOREIGN PATENT DOCUMENTS

| | | | |
|---|---|---|---|
| 959969 | 9/1922 | Switzerland | 223/119 |

*Primary Examiner*—Werner H. Schroeder
*Assistant Examiner*—Bibhu Mohanty
*Attorney, Agent, or Firm*—Bernard J. Murphy

[57] ABSTRACT

A platform, which has an elongate handle fixed thereto, has a pivotable limb coupled thereto to move an end of the limb away from, and into clamping engagement with the platform. An actuator is slidably secured to the platform by a trackway, and it has one end of a link captive in a diagonal slot formed in traverse of the actuator. The other end of the link penetrates the platform and is pivotably coupled to the limb. Slidable translation of the actuator along the platform causes the limb to pivot, to open a space between the platform and the limb, in which to insert an end or edge of a garment, and translation of the actuator in an opposite direction causes the limb to close toward the platform to clamp the garment securely thereto.

8 Claims, 2 Drawing Sheets

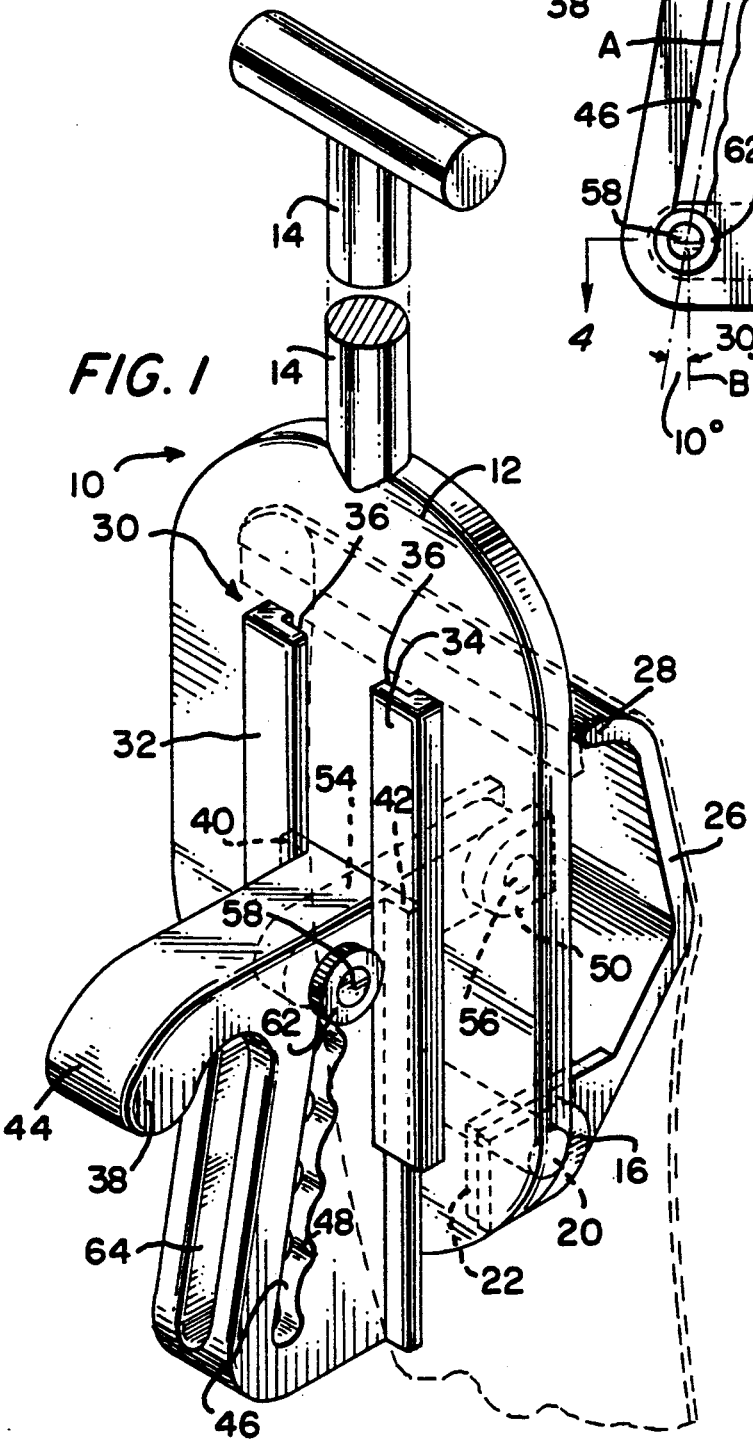
FIG. 1
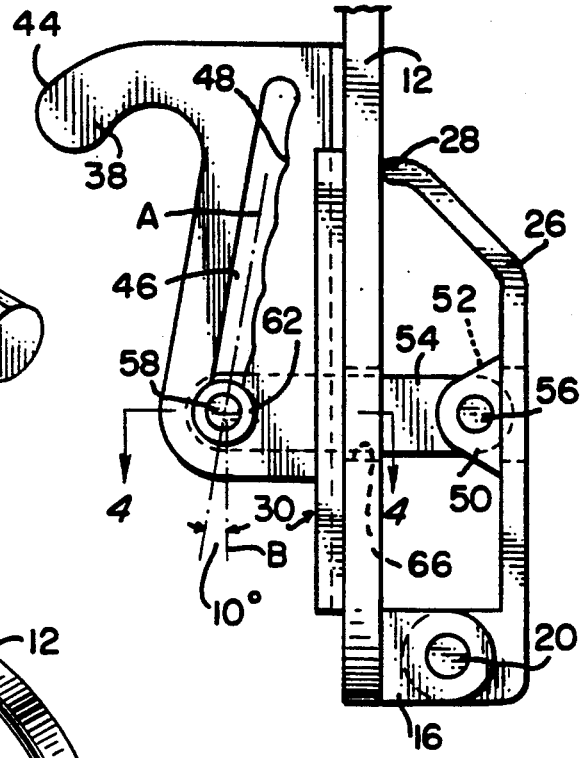
FIG. 3
FIG. 4
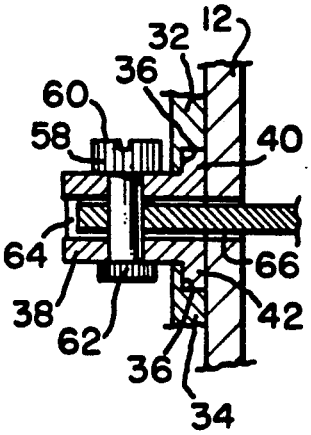

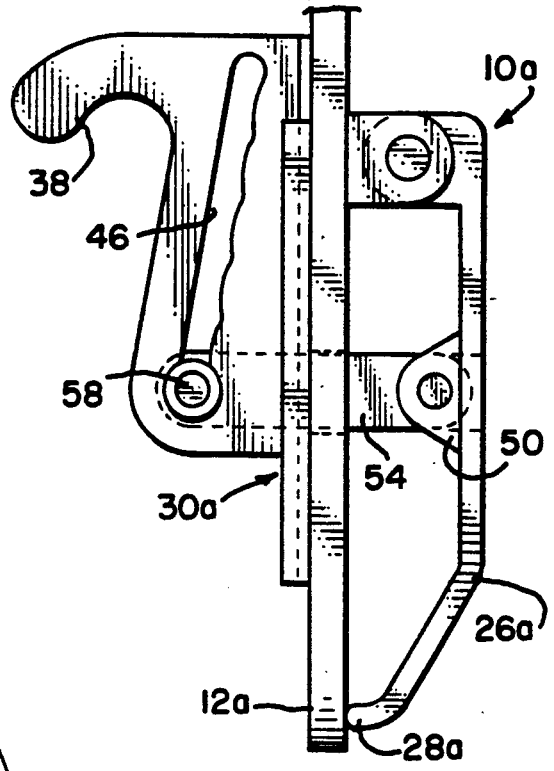
FIG. 6
FIG. 2
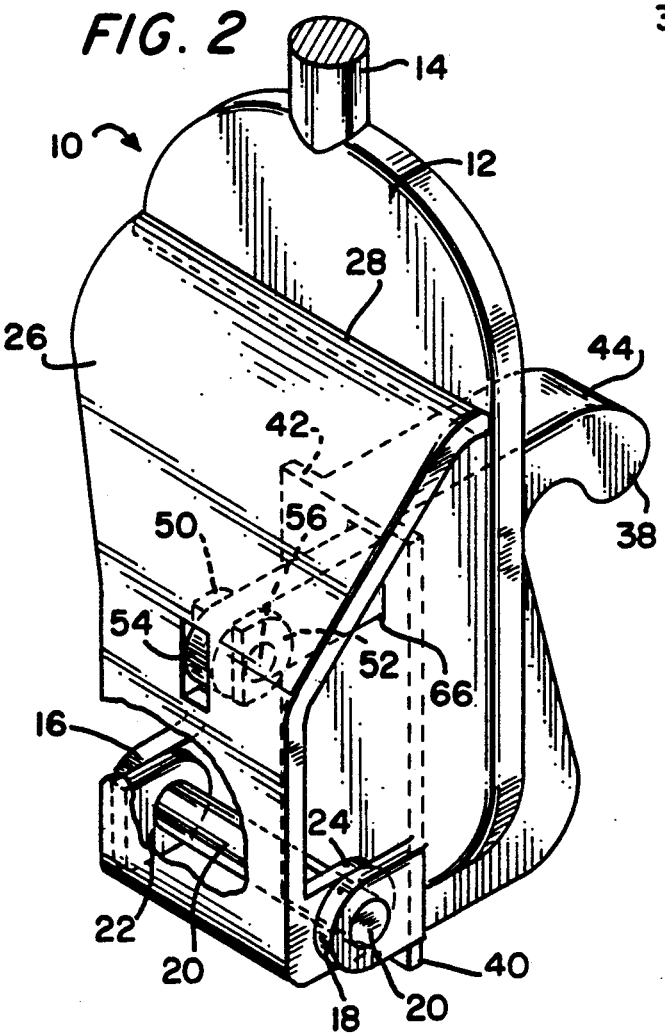
FIG. 5
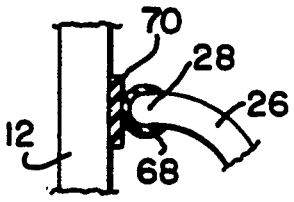

MECHANICAL GRIPPING DEVICE

This invention pertains to mechanical aids, and in particular to a mechanical gripping device.

There obtains a need for an efficient, mechanical gripping device, especially for persons afflicted with back ailments, knee joint problems, an amputated arm or hand, and the like, as an aid in dressing and undressing. Such devices would grip garments—underwear, slacks, and the like—at opposite sides thereof and, with the use of extended handles joined to the devices, one could draw the garments on, without having to bend the body, bend the knees, or could use one hand to alternately pull the devices upwardly, for instance.

It is an object of this invention, then, to set forth just such a long sought device.

Particularly, it is an object of this invention to disclose a mechanical gripping device comprising a platform; limb means having a first end thereof pivotably mounted to said platform, and a second end thereof movable through an arc (a) in a first direction, toward said platform, for fast, gripping engagement thereof with said platform, and (b) in a second direction, away from said platform, to define an open space between said second end and said platform; an actuator, slidably coupled to said platform for translation thereof along said platform and linkage means, coupled at opposite ends thereof to said actuator and said limb means, operative for moving said limb means in said first and second directions in response to translation of said actuator along said platform.

Further objects of this invention, as well as the novel features thereof, will become more apparent by reference to the following description taken in conjunction with the accompanying figures, in which:

FIG. 1 is a perspective illustration of the novel, mechanical gripping means, according to an embodiment thereof, showing one side of the device;

FIG. 2 is a perspective view, like that of FIG. 1, showing the opposite side of the device;

FIG. 3 is a side elevational view of the device;

FIG. 4 is a cross-sectional view taken along section 4—4 of FIG. 3;

FIG. 5 is a detail of the limb and platform showing the resilient pads; and

FIG. 6 is a side elevational view, like that of FIG. 3, of an alternative embodiment of the invention.

As shown in the figures, the novel, mechanical gripping device 10 comprises a platform 12 to which is fixed an elongate handle 14. At one end, the platform 12 has a pair of spaced apart lugs 16 and 18. The lugs 16 and 18 are apertured to receive pivot pins 20 therein pivotably to couple similar lugs 22 and 24 which are formed on an end of a limb 26. By this arrangement, the limb 26 can move its other end 28 through an arc (a) away from the platform 12, to define a space between end 28 and the platform, and (b) toward the platform, into fast, gripping engagement of the end 28 with the platform 12.

The platform 12 has a trackway 30 fixed thereto. The same comprises a pair of parallel rails 32 and 34 which have right-angular, and confronting, recesses 36 formed in edges thereof. An actuator 38, having a pair of parallel shoes 40 and 42 formed in the base thereof, is slidably engaged with the platform; the shoes 40 and 42 are slidably set in the recesses 36. The actuator 38 has a projecting finger grip 44. Further, the actuator 38 has a slot 46 formed therein which lies along a plane "A" which defines an angle of approximately ten degrees of arc with respect to a plane "B" which is parallel with the surface of the platform 12. The slot 46 has an undulated edge 48 formed therealong.

The limb 26 has a pair of pivot tabs 50 and 52 formed thereon, in parallel, to receive therebetween one end of a link 54. A pin 56 is passed through apertures in the tabs 50 and 52, and in the end of the link 54 to pivotably secure the latter thereto. The other end of the link 54 is slidably captive in the slot 46 by means of a fastener 58 passed through an aperture in this other end of the link. A fastener head 60 and a retainer 62 keep the fastener in place. The actuator 38 has a channel 64 formed therein, and lengthwise thereof in which to accommodate the slot-captive end of the link 54, and the platform 12 has a void 66 formed therein also to accommodate an intermediate portion of the like.

As can be appreciated, by study of the figures, translation of the actuator 38 downwardly, from the position shown in FIG. 3, will cause the link 54 to slide through the void 66, to the right (as viewed in FIG. 3) and, consequently, cause the limb 26 to pivot and move end 28 thereof away from the platform 12. Then, an edge of a garment, such as that shown in phantom in FIG. 1, can be emplaced between end 28 and the platform 12. Movement of the actuator 38, now, upwardly, will retract the link 54 through the void 66 again, and clamp the end 28 of the limb 26 into fast engagement with the platform 12; consequently, the garment will be securely held. The undulated edge 48 of the slot 46 provides graduated recesses into which the fastener 58 can nest to hold the limb 26 in the clamped engagement. While not shown in FIGS. 1, 2 or 3, the end 28 of the limb 26 has a nose of rubber material 68 cemented thereon, and the platform 12 also has a strip of rubber material 70 cemented thereon whereat the end 28 makes closing engagement, as shown in FIG. 5.

An alternative embodiment of the invention, designated 10*a*, is shown in FIG. 6. Herein, the same principle of operation, as used in the device 10, is employed, however, the gripping is effected at the lowermost end of the platform.

Same or similar index numbers shown in FIG. 6 denote same or similar parts and components as those in the device 10.

In device 10*a*, the limb 26*a* is reversed. Its gripping end 28*a* closes into fast, gripping engagement with the platform 12*a* in close proximity to the lowermost end of the platform 12*a*.

While I have described my invention in connection with specific embodiments thereof, it is to be clearly understood that this is done only by way of example, and not as a limitation to the scope of my invention, as set forth in the objects thereof and in the appended claims.

I claim:

1. A mechanical gripping device, comprising:

a platform;

limb means having a first end thereof pivotably journalled on said platform, and a second end thereof movable through an arc (a) in a first, arcing direction, toward said platform, for fast, gripping engagement thereof with said platform, and (b) in a second, reciprocal, arcing direction, away from said platform, to define an open space between said second end and said platform;

an actuator, slidably mounted upon said platform for translation thereof lengthwise of said platform; and elongate linkage means, coupled at one end thereof to said actuator, and pivotably coupled at the other end thereof to said limb means, operative for moving said limb means in said first and second directions in response to translation of said actuator lengthwise of said platform; wherein said actuator has an elongate slot formed therein;

said linkage means has an end thereof slidably captive in said slot;

said platform has a trackway fixed thereupon; and said actuator has shoes slidably engaged with said trackway; wherein said slot has an undulated edge therealong.

2. A mechanical gripping device, according to claim 1, wherein:

said platform occupies a given plane; and said slot extends along a plane which defines an acute angle with said given plane of said platform.

3. A mechanical gripping device, according to claim 2, wherein:

said acute angle of said slot is approximately ten degrees of arc.

4. A mechanical gripping device, according to claim 1, wherein:

said platform has a void formed therethrough; and said linkage means comprises a link in penetration of said void.

5. A mechanical gripping device, according to claim 1, further including:

an elongate handle joined to said platform.

6. A mechanical gripping device, according to claim 1, wherein:

said platform has a terminal edge; and said second end of said limb means, in arcing movement thereof in said first direction, closes into fast, gripping engagement thereof, as aforesaid, in proximate adjacency to said edge of said platform.

7. A mechanical gripping device, according to claim 1, wherein:

said second end of said limb means has compliant material fixed thereto.

8. A mechanical gripping device, according to claim 1, wherein:

said second end of said limb means closes into fast, gripping engagement thereof with said platform, as aforesaid, at a given location on said platform;

said platform has compliant material fixed thereto at said given location; and said second end of said limb means also has compliant material fixed thereto.

* * * * *